United States Patent [19]

Linderoth et al.

[11] Patent Number: 4,609,160

[45] Date of Patent: Sep. 2, 1986

[54] WINDING DEVICE FOR DRAWING-IN STRAND MATERIALS ON A DRUM

[75] Inventors: Gustaf Linderoth, Järfälla; Börje Ehn, Sundbyberg, both of Sweden

[73] Assignee: Skaltek AB, Kungsangen, Sweden

[21] Appl. No.: 712,456

[22] Filed: Mar. 15, 1985

Related U.S. Application Data

[63] Continuation-in-part of Ser. No. 491,861, May 5, 1983, abandoned.

[30] Foreign Application Priority Data

May 7, 1982 [SE] Sweden ..... 8202891

[51] Int. Cl.[4] ..... B65H 75/00; B65H 75/28; B65H 79/00

[52] U.S. Cl. ..... 242/54 R; 242/47; 242/117; 242/125.1

[58] Field of Search ..... 242/54 R, 77, 85, 117, 242/125.1, 129.5, 129.51, 47, 125.2, 125

[56] References Cited

U.S. PATENT DOCUMENTS

| | | | |
|---|---|---|---|
| 1,192,322 | 7/1916 | Jenkins | 242/117 |
| 1,625,503 | 4/1927 | Schooley | 242/117 X |
| 1,642,106 | 9/1927 | Fairbank | 242/117 |
| 2,225,180 | 12/1940 | Olesen | 242/125.1 X |
| 2,649,261 | 8/1953 | Badik et al. | 242/117 |
| 4,098,468 | 7/1978 | Skalleberg | 242/54 R |
| 4,387,863 | 6/1983 | Edmonston et al. | 242/125 X |

*Primary Examiner*—Stanley N. Gilreath
*Attorney, Agent, or Firm*—Carothers & Carothers

[57] ABSTRACT

A winding machine device for drawing a string-shaped article, such as an electric cable, a rope, a wire or the like, to a drum onto which said string-shaped article is to be wound, said drum being carried by mandrels which are insertable into center holes of a hub of the drum, at least one of the side walls of the drum being provided with an aperture to allow an inner end of the string-shaped article to extend from inside the drum to the outside of said side wall thereof. According to the invention a winding wheel is rigidly affixed to and coaxial with a machine driven one of said mandrels, a tracking rope or the like, one end of which is attachable to said end of said string-shaped article, being arranged to extend through said aperture in said drum wall and to be wound onto said winding wheel to draw said article to the drum and the leading end thereof through the aperture and a selected distance outside the side wall.

9 Claims, 6 Drawing Figures

WINDING DEVICE FOR DRAWING-IN STRAND MATERIALS ON A DRUM

This is a continuation-in-part of co-pending application Ser. No. 491,861 filed on May 5, 1983, now abandoned.

The present invention is in respect of a winding machine device for drawing-in a string-shaped article, such as an electric cable, a rope, a wire or the like, to be wound up by the machine onto a storage drum or reel fitted into the machine and to be rotated thereby on mandrels inserted in center holes of the drum. A leading end of, for instance, a cable is introduced through an aperture in at least one end wall to the drum.

Prior cable winding machines have incorporated apparatus for moving the machine mandrels laterally for insertion thereof into center holes of a drum, and apparatus for moving the mandrels vertically to lift the drum from a base or floor, as disclosed in U.S. Pat. No. 4,098,458 for example. The entire content of the cited U.S. Pat. No. 4,098,468 is incorporated herein and made a part hereof by this reference thereto.

When a large dimension electrical cable, for instance, in a conventional manner is to be wound up on a drum by means of a winding machine, the leading end of the cable is manually brought forward to the drum from a source, a cable manufacturing machine, for instance, and is manually secured to the drum, the cable therafter being wound on the drum by rotation of the drum. See for example U.S. Pat. No. 4,098,468. Heavy weight cables, weighing perhaps some tens of kilos per meter, calls for a number of men for bringing forward the cable and attaching it to the drum, this being a hard and troublesome element of work. To make possible an electrical test on the cable, the cable end has to extend through an aperture in one of the drum side walls, sometimes with a length of several meters. The manual effort required to draw large stiff cables through such an aperture can be a considerable one. Many cable manufacturing machines deliver a cable therefore as a finished or semi-fabricated article with a predetermined speed, below which the cable may be exposed to deficiences, a situation particularly valid for plastic and rubber extrusion operations during the course of manufacture. Consequently the time available for bringing the cable end through the aperture of a drum wall and attaching it to the drum is rather limited, causing a mental stress factor, and when, as the case may be, the work ends in a failure, costly rejections or repairs arise, followed by remanufacture.

The object of the present invention is to provide a device which eliminates the manual working procedure and brings forward the cable to the cable drum by machine aids by drawing the leading cable end through the side wall of the drum, automatically attaching the cable end to the drum and rapidly and safely handling the cable during the starting up of the winding.

According to the invention, this object is attained by means of a rope winding wheel which is rigidly affixed to and co-axially with a machine-driven one of said mandrels of the machine to be rotated therewith. A rope or the like, one end of which is attachable to said leading end of a string-shaped article that is to be wound on said mandrel carried drum, extends through an aperture in a side wall of the drum located adjacent said rope winding wheel and onto said wheel to be wound thereon while keeping the drum at rest, the mandrels not yet being fully engaged with the drum which still rests on the floor.

The invention may be better understood from the following description of a preferred embodiment, given by way of example and to be studied in conjunction with the accompanying drawings, in which.

Figure 1:
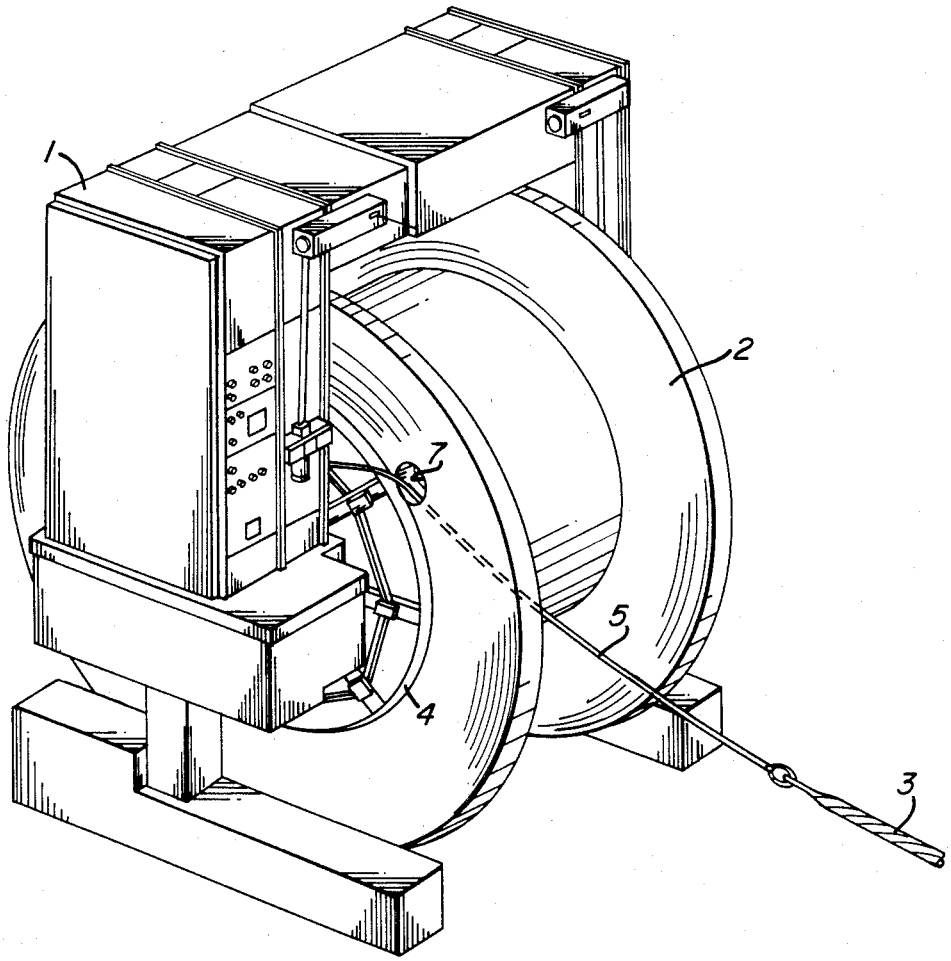
FIG. 1 is a perspective view of a winding machine equipped with a device according to the invention.
Figure 2:
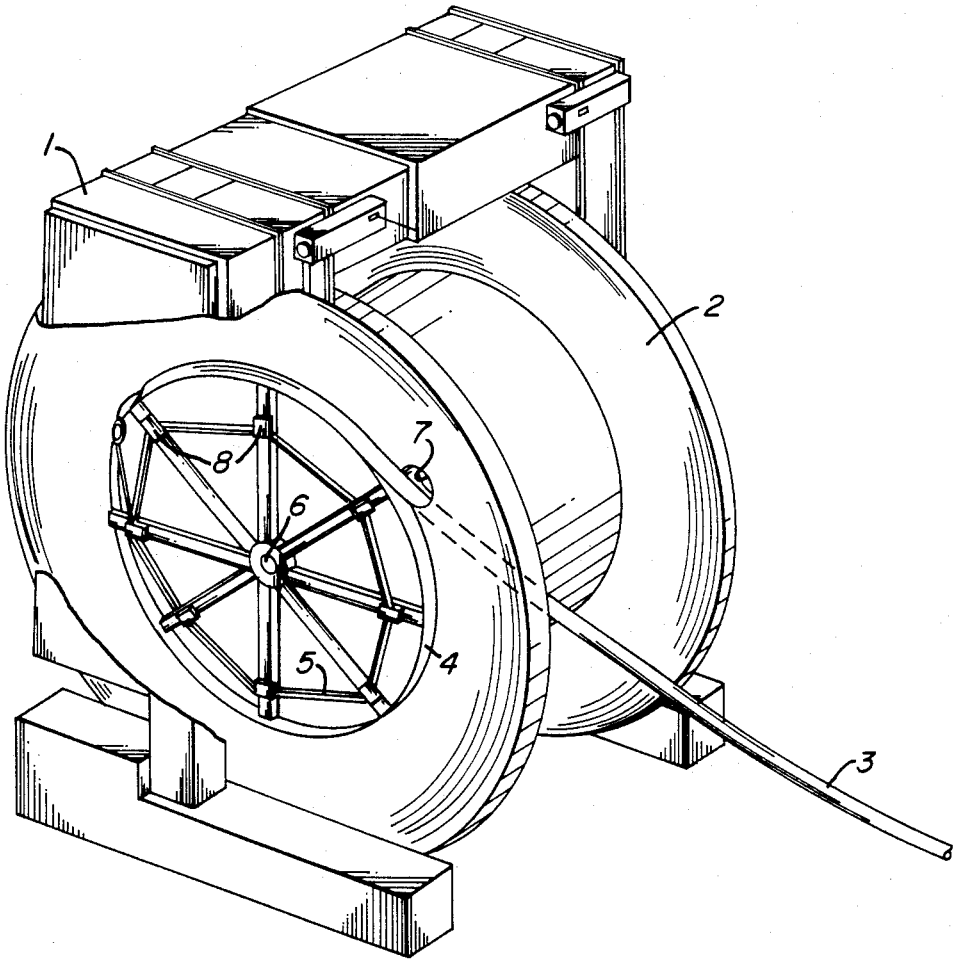
FIG. 2 is a view similar to the one of FIG. 1, however with parts of the winding machine removed.
Figure 6:
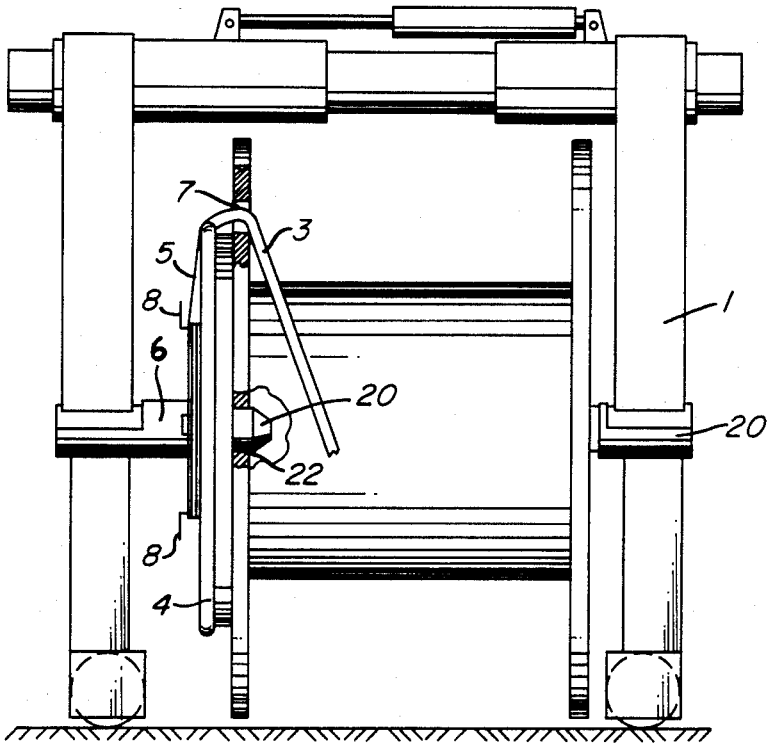
FIG. 6 is a simplified front elevation of the winding machine of FIG. 1.

FIGS. 1, 2 and 6 show a winding machine 1 carrying a drum 2 for winding a cable 3 or similar material. The winding machine 1 comprises two aligned mandrels or bosses 20, one being a driven mandrel 6, which are insertable in the same fashion as shown in U.S. Pat. No. 4,098,468 in the center apertures 22 of a drum, whereafter the mandrels 20 may be elevated in the known manner, for example as described in U.S. Pat. No. 4,098,468 to lift the drum free from a base to be carried rotatably about its center axis on the mandrel. A device according to the invention for drawing-in a cable comprises a rope winding wheel 4, said winding wheel 4 being co-axially and rigidly affixed at one of the mandrels 6 and about which a rope 5, a wire or the like is wound up. When a cable is to be wound on an empty drum, part of the rope 5 is unwound from the winding wheel while passing it through an aperture 7 in one of the drum side walls and the end brought to a point where the cable to be wound is to be delivered from a previous manufacturing step.

The rope 5 of the winding device is attached to the leading end of the cable 3, whereafter the winding wheel 4 with its driven mandrel 6 is set into rotation by means of the machine, the cable thus being drawn forward towards the drum 2 without manual work.

Initially, the drum in the center holes of which the mandrels of the machine are not yet fully inserted, still rests with its weight on the floor or other base and is not engaged by the winding wheel 4. The rope and cable thus are drawn through the aperture 7 of the drum wall and wound onto the winding wheel 4 by the driven mandrel 6 to which the winding wheel is rigidly affixed, being rotated by the machine. When a desired length of cable has been drawn through the aperture of the drum wall, then in a fashion similar to that shown in U.S. Pat. No. 4,098,468, the mandrels of the machine are fully introduced into the center holes of the drum while lifting the drum from the base in the known manner thus moving wheel 4 into engagement with the drum as shown in FIGS. 1, 2, and 6, and setting the drum into rotation to wind up the cable 3 on the drum 2. This procedure starts and commences without any manual attachment of the cable 3 to the drum 2 being necessary.

Figure 3:
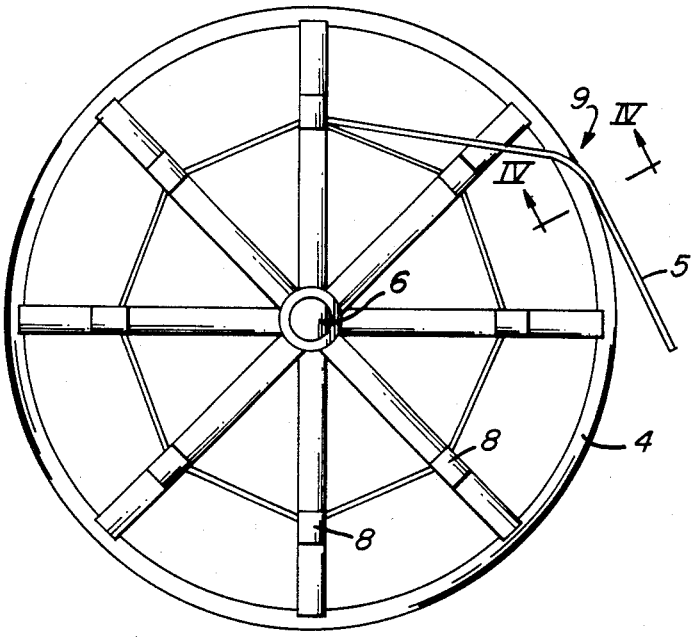
FIG. 3 is a side view of the device according to the invention.

The driving force for drum rotation is transferred from the machine driven winding wheel 4 by the rope 5 and the cable 3 to the drum 2 by friction between driven mandrel 6 and wheel 4 with drum 2 and also by the pinching of the cable at the aperture 7 of the drum wall and at the periphery of the winding wheel 4 when driven mandrel 6 with wheel 4 are engaged with drum 2 as shown in FIGS. 1 and 6. FIG. 3 is a lateral view of the winding wheel 4, where the rope 5 is wound up onto catches 8, said catches being arranged circumferentially at a centre distance which is substantially shorter than the radius of the winding wheel. Preferably, the diameter of the winding wheel substantially equals the diameter of the drum hub. The rope 5 is then bent over the periphery of the winding wheel 4, said rope 5 thus, as shown at 9, being curved at an angle so as to extend on the side of the winding wheel 4 where the catches 8 are located.

Figure 4:
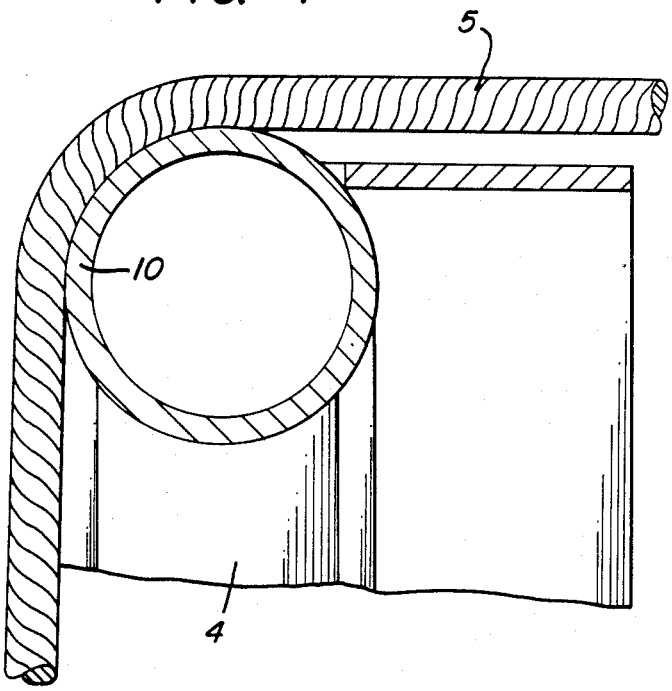
FIG. 4 is a cross-section at a larger scale along the line IV—IV in FIG. 3 of the device according to the invention.

By equipping a winding machine of the kind described with a device according to the invention, an automatic drawing-in of the cable end into the drum and subsequent holding it to keep the drum in rotation is obtained. Due to the selected location of the catches of the winding wheel, neither the rope nor the cable can cut or intrude in between the rotating winding wheel 4 and the drum as long as the drum still is at rest while wheel 4 is drawing-in the cable, thus preventing the rope 5 from being caught and wound up onto the mandrel. Obviously, the catches 8 may be replaced by an annular member in the form of a channel or shelf, onto which the rope 5 is wound. As illustrated by FIG. 4, the outer periphery of the winding wheel 4 consists of a bent tube 10, the rounded section of which enhances the possibility for the rope 5 to slide along the periphery of the winding wheel 4 while bringing forth the leading end of the cable to the machine. This feature is not limiting for the invention, but, in a preferred embodiment, the periphery of the winding wheel should consist of an annular member, the surface of which facing away from the wheel center has a rounded cross-section.

Figure 5:
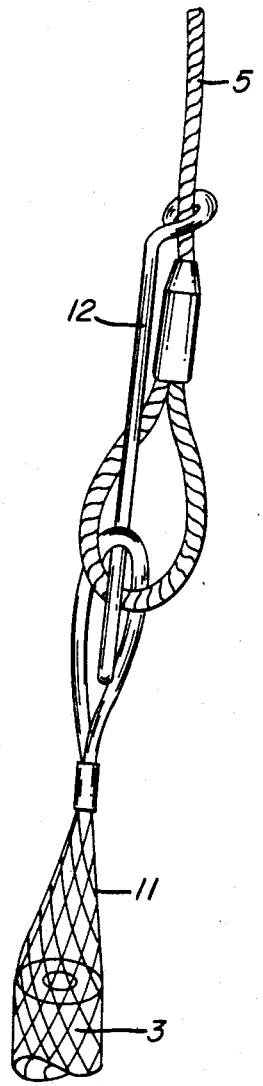
FIG. 5 is a partial side view of a connection between a rope and a cable end, illustrating a connection means suitable for the purpose.

FIG. 5 illustrates a coupling means for rapidly fastening and releasing the connection between the rope 5 and the cable 3. When drawing-in the cable, the cable end is held by means of a conventional steel wire drawing stocking 11 provided with an eye. The end of line 5 is, as well, provided with an eye, and carries a pin 12, slideably attached thereto. The drawing stocking 11 is swiftly attached to the rope 5 by inserting the pin 12 as illustrated by FIG. 5. Even if the connection is tightened by large forces, it may be easily released by beating the pin 12 out of the eyes.

We claim:

1. A winding machine for drawing-in a leading end of a string-shaped article (3), such as an electric cable, a rope, a wire or the like, to a drum (2) for winding said article onto a drum, comprising a drum having a hub and at least one side wall, mandrels which are insertable into end center holes provided in said drum hub to thereby carry said drum, means for rotatably driving at least one of said mandrels, said at least one side wall provided with an aperture (7) therethrough for an end of said string-shaped article to extend through from inside the drum to the outside of said side wall, the improvement comprising a rope winding wheel (4) rigidly affixed to and co-axially aligned with a rotatably driven one of said mandrels to be rotated therewith, a rope (50) or the like, one end of which is attachable to a leading end of a string-shaped article that is to be wound on said mandrel carried drum, said rope extending through said aperture (7) in said side wall of the drum located adjacent said rope winding wheel and onto said wheel to be wound thereon, while keeping said side wall of the drum adjacent said winding wheel at rest by not fully engaging the driven wheel and mandrel with the drum.

2. The improvement according to claim 1, characterized by said winding wheel (4) comprising rope supporting means adapted for winding said rope (5), and by at least one side wall portion of said rope supporting means facing the drum (2).

3. The improvement according to claim 2, characterized by said rope supporting means consisting of catches (8), distributed in the peripheral direction of the winding wheel (4) and arranged at a distance from the center of said winding wheel substantially shorter than the winding wheel radius.

4. The improvement according to claim 1, characterized by the periphery of said winding wheel (4) consisting of an annular member (10), the surface of which directed from the center of said wheel being rounded as seen in the cross-section thereof.

5. The improvement according to claim 1, characterized by the diameter of the winding wheel (4) substantially equaling the diameter of the hub of the drum (2).

6. In a winding system for winding an elongated strand on a drum having a sidewall portion with a strand end receiving aperture therein wherein a winding machine includes a pair of mandrels which are selectively engageable and disengageable with such a drum in a manner to selectively support the drum for axial rotation thereof to wind such a strand thereon, the improved structure for initiating such winding of such a strand comprising:

drive means for driving at least one of said mandrels in axial rotation; a winding wheel rigidly affixed coaxially on said at least one of said mandrels for rotation therewith; a rope or the like having one end thereof attached to a circumferentially extending peripheral portion of said winding wheel and the opposite end thereof being passable throughout the aperture in the sidewall of a drum positioned adjacent thereto and being attachable to the leading end of such a strand, whereby, upon rotation of said one of said mandrels while disengaged from the drum said rope is drawn through such aperture and taken upon said peripheral portion of said winding wheel to draw the attached leading end of such strand to the stationary drum and through such aperture to engage said winding wheel, and said winding wheel including means for rotary driving engagement with such a sidewall portion of such drum when the drum is supported by said mandrels such that upon subsequent rotation of said at least one of said mandrels said winding wheel drivingly engages such drum sidewall portion to drive the drum in axial rotation and thereby wind such a strand on the drum.

7. The improved structure as specified in claim 6 wherein said means for rotary driving engagement includes friction means for frictional engagement between such drum sidewall portion and said winding wheel.

8. The improved structure as specified in claim 6 wherein said means for rotary driving engagement includes pinching means for pinching of such leading end against such drum sidewall portion.

9. The improved structure as specified in claim 6 wherein said means for rotary driving engagement includes means for frictional engagement of such a leading end within such aperture.

* * * * *